US011603582B2

(12) United States Patent
Suzuki et al.

(10) Patent No.: US 11,603,582 B2
(45) Date of Patent: Mar. 14, 2023

(54) AL—SI—FE-BASED ALUMINUM ALLOY CASTING MATERIAL AND METHOD FOR PRODUCING THE SAME

(71) Applicant: NIPPON LIGHT METAL COMPANY, LTD., Tokyo (JP)

(72) Inventors: Satoru Suzuki, Shizuoka (JP); Kazuhiro Oda, Shizuoka (JP); Katumi Fukaya, Aichi (JP)

(73) Assignee: NIPPON LIGHT METAL COMPANY, LTD., Tokyo (JP)

( * ) Notice: Subject to any disclaimer, the term of this patent is extended or adjusted under 35 U.S.C. 154(b) by 595 days.

(21) Appl. No.: 16/606,146

(22) PCT Filed: Apr. 19, 2017

(86) PCT No.: PCT/JP2017/015697
§ 371 (c)(1),
(2) Date: Oct. 17, 2019

(87) PCT Pub. No.: WO2018/193543
PCT Pub. Date: Oct. 25, 2018

(65) Prior Publication Data

US 2020/0048745 A1 Feb. 13, 2020

(51) Int. Cl.
*C22C 21/02* (2006.01)
*C22C 1/02* (2006.01)
*C22F 1/043* (2006.01)

(52) U.S. Cl.
CPC ..... *C22C 21/02* (2013.01); *C22C 1/026* (2013.01); *C22F 1/043* (2013.01)

(58) Field of Classification Search
CPC ..... C22C 21/02
See application file for complete search history.

(56) References Cited

U.S. PATENT DOCUMENTS 5,762,728 A * 6/1998 Kuramasu ..... C22C 21/04 148/439
2014/0283651 A1* 9/2014 Oda ..... C22F 1/043 75/684

FOREIGN PATENT DOCUMENTS

CN 1542151 A 11/2004
CN 102764957 A 11/2012
(Continued)

OTHER PUBLICATIONS

Yuying Yang et al., "Effect of Cr content and heat-treatment on the high temperature strength of eutectic Al—Si alloys," Journal of Alloys and Compounds, 647, 2015, pp. 63-69.
(Continued)

*Primary Examiner* — Christopher S Kessler
(74) *Attorney, Agent, or Firm* — McDermott Will & Emery LLP

(57) ABSTRACT

An Al—Si—Fe-based aluminum alloy casting material that is excellent in elongation while having characteristics of high rigidity and a method for producing the same are provided. The Al—Si—Fe-based aluminum alloy casting material has a composition that includes: Si, a content of which is 12.0% by mass or more and 25.0% by mass or less; Fe, a content of which is 0.48% by mass or more and 4.0% by mass or less; Cr, a content of which is 0.17% by mass or more and 5.0% by mass or less; and a remainder composed of Al and unavoidable impurities. The casting material includes a structure, in which a Si-based crystallized product surrounds an Al—Cr—Si-based compound.

4 Claims, 2 Drawing Sheets

(56) References Cited

FOREIGN PATENT DOCUMENTS

| | | | |
|---|---|---|---|
| EP | 0672670 | A1 | 9/1995 |
| EP | 1762631 | A1 | 3/2007 |
| JP | H07-270209 | A | 10/1995 |
| JP | H09-324235 | A | 12/1997 |
| JP | 2000-1731 | A | 1/2000 |
| JP | 2001-288526 | A | 10/2001 |
| JP | 2002-356755 | A | 12/2002 |

OTHER PUBLICATIONS

Extended European Search Report issued in corresponding European Patent Application No. 17906611.3, dated Sep. 1, 2020.
International Search Report issued in corresponding Intenational Patent Application No. PCT/JP2017/015697, dated Jul. 18, 2017, with English translation.

* cited by examiner

AL—SI—FE-BASED ALUMINUM ALLOY CASTING MATERIAL AND METHOD FOR PRODUCING THE SAME

CROSS-REFERENCE TO RELATED APPLICATIONS

This application is the U.S. National Stage under 35 U.S.C. § 371 of International Application No. PCT/JP2017/015697 filed on Apr. 19, 2017, which designates the United States, the entire contents of which are incorporated herein by reference.

1. TECHNICAL FIELD

The present invention relates to an Al—Si—Fe-based aluminum alloy casting material and a method for producing the same.

2. DESCRIPTION OF THE RELATED ART

Aluminum (Al) alloys containing silicon (Si) as a hypereutectic composition have been known. In the Al—Si-based aluminum alloy, a Si-based compound (primary crystal Si) crystallizes out so that high rigidity, low linear expansivity, and abrasion resistance are obtained (refer to Prior Art 1).

An Al—Si—Fe-based aluminum alloy having high rigidity and improved low linear expansivity obtained by forming an Al—Fe—Si-based crystallized product by further adding Fe to the Al—Si-based aluminum alloy has also been known (refer to Prior Art 2).

In the Al—Si—Fe-based aluminum alloy, an increase in content of Si and Fe may cause coarsening of the Si-based crystallized product and needle-like product formation of the Al—Fe—Si-based crystallized product. For this reason, in order to inhibit the coarsening of the Si-based crystallized product and the needle-like product formation of the Al—Fe—Si-based crystallized product, phosphorus (P) and manganese (Mn) are added to the Al—Si—Fe-based aluminum alloy.

CITATION LIST

Patent Literature

Prior Art 1: Japanese Patent Application Laid-open No. H7-270209

Prior Art 2: Japanese Patent Application Laid-open No. H9-324235

In recent years, the Al—Si—Fe-based aluminum alloy has been required to have higher rigidity and a lower linear expansivity. In order for the Al—Si—Fe-based aluminum alloy to obtain the higher rigidity and the lower linear expansivity, larger amounts of primary crystal Si and Al—Fe—Si-based intermetallic compound need to crystallize out. In order to crystallize larger amounts of these crystallized products, the contents of Si and Fe in the Al—Si—Fe-based aluminum alloy are required to increase. However, an increase in additive amount of P when Si is increased cannot sufficiently inhibit the coarsening of the Si-based crystallized product. Meanwhile, the increase in additive amount of P decreases melt fluidity of a molten alloy, thereby deteriorating castability. An increase in additive amount of Mn in order to inhibit the needle-like product formation of the Al—Fe—Si-based crystallized product causes crystallization of a coarse Mn-based compound, which is responsible for a decrease in elongation.

For the foregoing reasons, aspects of the present invention aim to provide an Al—Si—Fe-based aluminum alloy casting material that is excellent in elongation, while having the characteristics of high rigidity or low linear expansivity, and a method for producing the same.

SUMMARY

According to a first aspect of the present invention, an Al—Si—Fe-based aluminum alloy casting material has a composition that includes: Si, a content of which is 12.0% by mass or more and 25.0% by mass or less; Fe, a content of which is 0.48% by mass or more and 4.0% by mass or less; Cr, a content of which is 0.17% by mass or more and 5.0% by mass or less; and a remainder composed of Al and unavoidable impurities. The casting material includes a structure, in which a Si-based crystallized product surrounds an Al—Cr—Si-based compound.

As a preferred aspect, the content of Cr and the content of Si satisfy the following formula (1):

$$Cr>0.018\times Si-0.2 \quad (1)$$

As a preferred aspect, the structure further includes an Al—Fe—Si-based crystallized product. An area ratio of the Al—Fe—Si-based crystallized product is 5% or more. A maximum diameter of the Al—Fe—Si-based crystallized product is 30 μm or less. An area ratio of the Si crystallized product is 12% or more. A maximum diameter of the Si-based crystallized product is 100 μm or less.

As a preferred aspect, the Al—Si—Fe-based aluminum alloy casting material further includes any one or more elements of: Cu, a content of which is 0.5% by mass or more and 8.0% by mass or less; Ni, a content of which is 0.5% by mass or more and 6.0% by mass or less; Mg, a content of which is 0.05% by mass or more and 1.5% by mass or less; P, a content of which is 0.003% by mass or more and 0.02% by mass or less; Mn, a content of which is 0.3% by mass or more and 1.0% by mass or less; Ti, a content of which is 0.005% by mass or more and 1.0% by mass or less; B, a content of which is 0.001% by mass or more and 0.01% by mass or less; Zr, a content of which is 0.01% by mass or more and 1.0% by mass or less; and V, a content of which is 0.01% by mass or more and 1.0% by mass or less.

According to a second aspect of the present invention, a method for producing an Al—Si—Fe-based aluminum alloy casting material, the method includes: casting at a cooling rate of 500° C./s or more an Al—Si—Fe-based aluminum alloy having a composition including: Si, a content of which is 12.0% by mass or more and 25.0% by mass or less; Fe, a content of which is 0.48% by mass or more and 4.0% by mass or less; Cr, a content of which is 0.17% by mass or more and 5.0% by mass or less; and a remainder composed of Al and unavoidable impurities.

As a preferred aspect, the method for producing the Al—Si—Fe-based aluminum alloy casting material further includes performing solidification by generating a supercooled state at 30° C. or more than a liquidus line temperature.

According to the aspects of the present invention, the Al—Si—Fe-based aluminum alloy casting material that is excellent in elongation, while having the characteristics of high rigidity or low linear expansivity, and the method for producing the same can be provided.

DETAILED DESCRIPTION

Figure 1A:
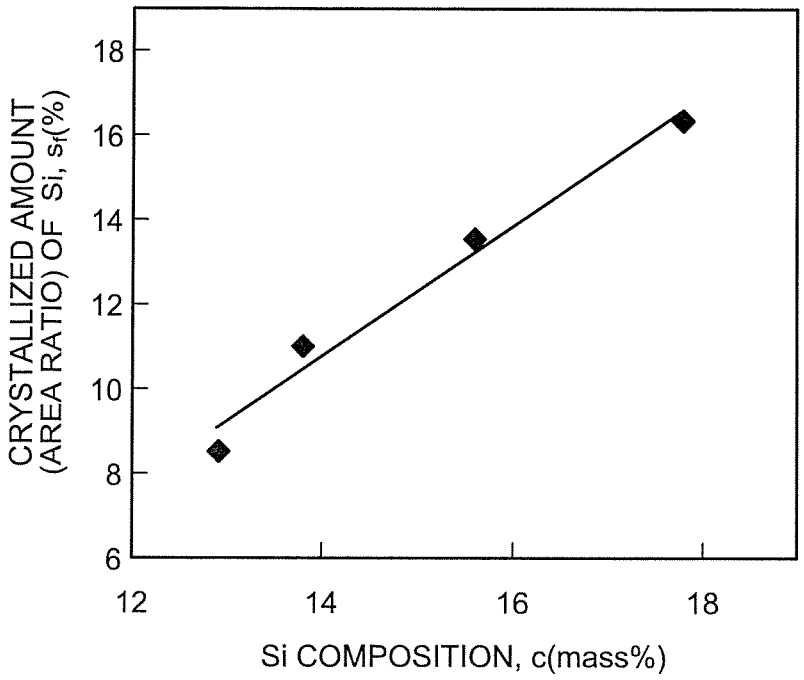
FIG. 1A is a diagram for explaining a relation between a Si content and an area ratio of Si in an Al—Si-based aluminum alloy casting material.

An embodiment according to the present invention is described below with reference to the drawings but the present invention is not limited thereto. Constituent elements of the embodiment described below can be combined as appropriate. In some cases, part of the constituent elements may not be used. The constituent elements in the embodiment described below include elements that can be easily conceived of by a person skilled in the art, elements substantially equivalent thereto, and elements within a so-called range of equivalents.

Through extensive research, the inventors of the present invention have found that when an Al—Si—Fe-based aluminum alloy containing Cr is quenched and solidified during casting, an Al—Cr—Si-based compound crystalizes out before crystallization of a Si-based crystallized product and becomes the crystallization nucleus of the Si-based crystallized product to act as inhibition of coarsening. The action has also been found on a high Si content aluminum alloy, in which the content of Si is more than 16%.

Furthermore, it has been found that quenching causes supercooling during solidification and the Si-based compound and the Al—Fe—Si-based compound crystallize out almost simultaneously, so that the Al—Fe—Si-based compound becomes less likely to form a needle-like product.

For this reason, the aluminum alloy casting material according to the present embodiment is cooled at a cooling rate of 500° C./s or more and solidified at the time of casting to have a structure, in which the Si-based crystallized product is in contact with the Al—Cr—Si-based compound. The following describes in detail the aluminum alloy casting material according to the present embodiment.

(Alloy Composition)

The Al—Si—Fe-based aluminum alloy according to the present embodiment has a composition including 12.0% by mass or more and 25.0% by mass or less of Si, 0.48% by mass or more and 4.0% by mass or less of Fe, 0.17% by mass or more and 5.0% by mass or less of Cr, and the remainder composed of Al and unavoidable impurities.

In the Al—Si—Fe-based aluminum alloy according to the present embodiment, Si improves the castability; crystalizes out as the Si-based compound to provide the action of increasing rigidity and abrasion resistance; and provides the action of lowering the linear expansivity. When the Si content is less than 12.0% by mass, sufficient crystallization of the Si-based compound cannot be obtained, and the action of improving rigidity and abrasion resistance cannot be sufficiently exhibited. On the other hand, when the Si content is more than 25.0% by mass, the castability decreases. Preferably, the Si content is 14.0% by mass or more, and more preferably, the Si content is 16.0% by mass or more, which allows the casting material to have excellent castability, improved rigidity, and improved abrasion resistance.

In the Al—Si—Fe-based aluminum alloy according to the present embodiment, Fe provides the action of inhibiting a seizure to a mold during casting and the action of improving mechanical properties such as rigidity. These actions become remarkable when the Fe content is 0.48% by mass or more. When the Fe content is more than 4.0% by mass, a resultant compound is more likely to crystallize out as an Al—Fe—Si-based compound that is coarse and forms a needle-like product, which is a contributing factor to decrease elongation.

Cr crystallizes out as an Al—Cr—Si-based compound when quenched during casting, and becomes the crystallization nucleus of the Si-based crystallized product to act as inhibition of coarsening. This action becomes remarkable when the Cr content is 0.3% by mass or more. When the Cr content is more than 5.0% by mass, a resultant compound is more likely to crystallize out as a coarse Al—(Fe, Cr, Mn)—Si-based compound, which is a contributing factor to decrease elongation.

When the Cr content is (0.018×Si−0.2)% by mass or less, a crystallization temperature of the Al—Cr—Si-based compound is lower than a crystallization temperature of the Si-based compound, thereby inhibiting the action, by which the Al—Cr—Si-based compound becomes the crystallization nucleus of the Si-based compound. When the Cr content and the Si content satisfy the following formula (1), the Al—Cr—Si-based compound is more likely to crystalize out before the crystallization of the Si-based crystallized product at the time of solidification.

$$Cr > 0.018 \times Si - 0.2 \quad (1)$$

In the Al—Si—Fe-based aluminum alloy according to the present embodiment, any one or more of the elements of copper (Cu), nickel (Ni), magnesium (Mg), phosphorus (P), manganese (Mn), titanium (Ti), boron (B), zirconium (Zr), and vanadium (V) may be included in addition to Fe and Cr in order to improve mechanical properties.

Because Cu acts to improve mechanical properties, Cu is added if necessary. When Cu is added together with Ni, a resultant compound crystallizes out as an Al—Ni—Cu compound, thereby improving rigidity and high-temperature strength while exhibiting the action of lowering the linear expansivity. This action becomes remarkable when the additive content of Cu is 0.5% by mass or more. When the Cu content is more than 8.0% by mass, a coarse compound is formed, which is a contributing factor to decrease elongation. The Cu content of more than 8% by mass further deteriorates corrosion resistance. Therefore, the Cu content is preferably 0.5% by mass or more and 8% by mass or less.

Because Ni acts to improve mechanical properties, Ni is added if necessary. When Ni is added together with Cu, a resultant compound crystallizes out as an Al—Ni—Cu compound, thereby improving rigidity and high-temperature strength while exhibiting the action of lowering the linear expansivity. This action becomes remarkable when the additive content of Ni is 0.5% by mass or more. The Ni content of more than 6.0% by mass increases a liquidus-line temperature, thereby deteriorating castability. Therefore, the Ni content is preferably 0.5% by mass or more and 6% by mass or less.

Because Mg acts to improve mechanical properties, Mg is added if necessary. This action becomes remarkable when the additive content of Mg is 0.05% by mass or more. When the additive content of Mg is more than 1.5% by mass, the mother phase of Al hardens, which is a contributing factor to decrease elongation. Therefore, the Mg content is preferably 0.05% by mass or more and 1.5% by mass or less.

P becomes the crystallization nucleus of the Si-based compound as an Al—P-based compound, and acts to fine the Si-based compound. This action becomes remarkable when the additive content of P is 0.003% by mass. When the additive content of P is more than 0.02% by mass, the melt fluidity of a molten alloy decreases, thereby decreasing the castability. Therefore, the P content is preferably 0.003% by mass or more and 0.02% by mass or less.

Mn acts to agglomerate the Al—Fe—Si-based compound. A coarse needle-like Al—Fe—Si-based compound generates the starting point of fracture, which is a contributing factor to decrease elongation. However, the addition of Mn for agglomeration inhibits the decrease in elongation. This action becomes remarkable when the added content of Mn is 0.3% by mass or more. When the added content of Mn is more than 1.0% by mass, a coarse Al—(Fe, Mn, Cr)—Si-based compound is formed, which is a contributing factor to decrease elongation.

Inclusion of any one or more elements of Ti, B, Zr, and V exhibits the action as a material for fining crystal grains so as to improve castability, and also exhibits the action of improving a mechanical action. Mn is preferably added in the range of 0.3% by mass or more and 1.0% by mass or less. Ti is preferably added in the range of 0.005% by mass or more and 1.0% by mass or less. B is preferably added in the range of 0.001% by mass or more and 0.01% by mass or less. Zr is preferably added in the range of 0.01% by mass or more and 1.0% by mass or less. V is preferably added in the range of 0.01% by mass or more and 1.0% by mass or less.

The Si-based crystallized product contributes to improving rigidity, abrasion resistance, heat resistance, and the like of the casting material, while contributing to lowering the linear expansivity. This action becomes remarkable when the area ratio of the Si-based crystallized product is 12% or more.

Figure 1B:
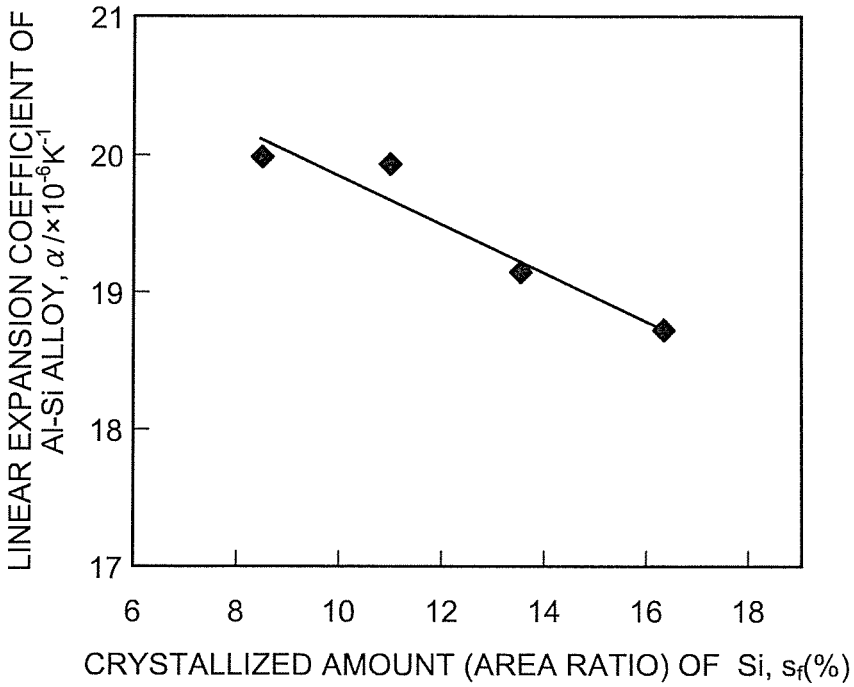
FIG. 1B is a diagram for explaining a relation between the area ratio of Si and a linear expansion coefficient of Si in the Al—Si-based aluminum alloy casting material.

FIG. 1A is a diagram for explaining a relation between the Si content and the area ratio of Si in the Al—Si-based aluminum alloy casting material. FIG. 1B is a diagram for explaining a relation between the area ratio of Si and the linear expansion coefficient of Si in the Al—Si-based aluminum alloy casting material. As illustrated in FIG. 1A, when the Si content is 14.0% by mass or more, the Si-based compound is more likely to crystallize out, and the area ratio of the Si-based crystallized product is more likely to be more than 12%. As illustrated in FIG. 1B, as the area ratio of the Si-based crystallized product increases, the linear expansivity becomes low. When the area ratio of the Si-based crystallized product is about 8%, the linear expansion coefficient is $21\times10^{-6}$/° C. When the area ratio of the Si-based crystallized product is about 12%, the linear expansion coefficient can be made lower than 21×10-6/° C.

However, when the Si content is increased, the Si-based compound is more likely to coarsen. For example, the Si-based crystallized product having a particle diameter (equivalent circle diameter) of more than 100 μm in the structure acts as the starting point of fracture when force is applied to the casting material. This decreases elongation of the casting material. Therefore, the particle diameter (circle equivalent diameter) of the Si-based crystallized product is preferably 100 μm or less.

The Al—Fe—Si-based crystallized product contributes to improving rigidity, heat resistance, and the like of the casting material, while contributing to lowering the linear expansivity. This action becomes remarkable when the area ratio of the Al—Fe—Si-based crystallized product is 5% or more. The Al—Fe—Si-based crystallized product having a particle diameter (equivalent circle diameter) of more than 30 μm in the structure acts as the starting point of fracture when force is applied to the casting material, thereby decreasing the elongation of the casting material. Cooling the molten alloy having the alloy composition according to the present embodiment in a supercooled state at 30° C. or more than the liquidus line temperature causes the Si-based compound and the Al—Fe—Si-based compound to crystallize out almost simultaneously. As a result, the needle-like product formation of the Al—Fe—Si-based compound can be inhibited, and the granular Al—Fe—Si-based compound can be obtained.

When the molten alloy having the above-described alloy composition is cooled at 500° C./s or more and solidified, a fine Al—Cr—Si-based compound crystallizes out. According to an X-ray diffraction analysis, the Al—Cr—Si-based compound is determined to be α-AlCrSi. In order to examine the effectiveness as the heterogeneous nucleus of α-AlCrSi, comparison was made with respect to a crystal structure of each phase and a degree of incoherency between Si and each compound. Here, $a_0$ is a lattice constant of Si and a is a lattice constant of the Al—P-based compound or the Al—Cr—Si-based compound as the heterogeneous nucleus. The Al—P-based compound belongs to the same crystal system as Si and has the lattice constant close to that of Si. While α-AlCrSi belongs to the same crystal system as Si, the lattice constant a is twice as high as the lattice constant $a_0$ of Si. The crystal structure of the Al—Cr—Si-based compound is cubical crystal and the crystal structure of Si is also cubical crystal. Accordingly, the inventors of the present invention calculated a degree of coherency by doubling the lattice constant $a_0$ to find that the crystal structure of the Al—Cr—Si-based compound and the crystal structure of the Si-based compound have a high degree of coherency (low degree of incoherency).

TABLE 1

| Phase | Crystal system | Lattice constant, a/nm | Degree of incoherency, δ (%) $\lvert a_0 - a\rvert/a_0$ | $\lvert 2a_0 - a\rvert/2a_0$ |
|---|---|---|---|---|
| Si | Cubical crystal | 0.54286 | | |
| Al-P | Cubical crystal | 0.54625 | 0.62 | |
| α-AlCrSi | Cubical crystal | 1.0917 | | 0.55 |

While the above-described Al—P-based compound can also be the crystallization nucleus of the Si-based compound, the Al—Cr—Si-based compound has a higher degree of coherency in the crystal structure with the Si-based compound than that of the Al—P-based compound. Therefore, the Al—Cr—Si-based compound is more suitable than the Al—P-based compound as the crystallization nucleus.

Further addition of P to the molten alloy having the above-described alloy composition allows the Al—P-based compound to act as the crystallization nucleus following the Al—Cr—Si-based compound. Further, this alloy can increase the number of pieces of the Si-based crystallized product and can increase the area ratio of the Si-based crystallized product compared with the alloy to which Cr alone is added.

The molten alloy having the above-described alloy composition is cooled at 500° C./s or more and solidified so that the amount of the Al—Cr—Si-based crystallized compound is greater than the amount of the Si-based crystallized compound. When the Si-based compound crystallizes out with the above-mentioned state, the Al—Cr—Si-based compound acts as the crystallization nucleus. As a result, a large amount of Si-based compound exists around the Al—Cr—Si-based compound acting as the crystallization nucleus. For example, part of the Al—Cr—Si-based compound acts as the crystallization nucleus and is surrounded with the Si-based crystallized product. Part of the Al—Cr—Si-based compound, which acts as the crystallization nucleus, need not be completely surrounded with the Si-based crystallized product.

The Al—Cr—Si-based compound acting as the crystallization nucleus inhibits the coarsening of the Si-based crystallized product. Accordingly, even when the Si content is increased, the Al—Si—Fe-based aluminum alloy according to the present embodiment has high tensile strength and high rigidity, and can inhibit the decrease in elongation. Further, the Al—Si—Fe-based aluminum alloy according to the present embodiment can obtain the characteristics of the low linear expansivity by increasing the area ratio of the Si-based crystallized product.

C. This can mutually inhibit the coarsening and the needle-like product formation of the Al—Fe—Si-based compound.

Examples

The following describes Examples according to the present invention. As Examples 1 to 7 and Comparative Examples 1 and 2, the molten alloys having respective alloy compositions composed of respective alloy element amounts listed in Table 2, the remainder being Al, were produced in the molten state. These alloys were die-cast such that the cooling rate is 500° C./s or more and the supercooled state at 30° C. or more than the liquidus line temperature was generated, and then casts were obtained. Each casting temperature of Examples 1 to 7 and Comparative Examples 1 and 2 was 780° C.

TABLE 2

| | Composition (% by mass) | | | | | | | Cr > 0018 × Si − 0.2 | | Si-based crystallized product | | Al—Fe—Si-based product | | Tensile strength, MPa | Elongation (%) |
|---|---|---|---|---|---|---|---|---|---|---|---|---|---|---|---|
| | Si | Fe | Cr | Cu | Ni | Mg | P | | | Size, μm | Area ratio (%) | Size, μm | Area ratio (%) | | |
| Example 1 | 17.3 | 0.48 | 0.35 | <0.01 | <0.01 | <0.01 | <0.01 | 0.2386 | ○ | 79 | 16.2 | 23 | 15.1 | 227 | 1.2 |
| Example 2 | 17.5 | 0.55 | 0.51 | <0.01 | <0.01 | <0.01 | <0.01 | 0.395 | ○ | 76 | 15.7 | 21 | 14.2 | 220 | 0.9 |
| Example 3 | 17.6 | 0.53 | 0.64 | <0.01 | <0.01 | <0.01 | <0.01 | 0.5232 | ○ | 75 | 15.5 | 20 | 13.8 | 208 | 0.7 |
| Example 4 | 17.5 | 0.53 | 0.38 | 0.58 | <0.01 | <0.01 | 0.011 | 0.265 | ○ | 55 | 15.5 | 25 | 14.9 | 233 | 1.2 |
| Example 5 | 17.3 | 0.51 | 0.40 | <0.01 | 0.61 | <0.01 | 0.010 | 0.2886 | ○ | 57 | 15.2 | 24 | 13.5 | 250 | 1.1 |
| Example 6 | 17.4 | 0.50 | 0.41 | <0.01 | <0.01 | 0.52 | 0.011 | 0.2968 | ○ | 55 | 16.5 | 24 | 14.2 | 242 | 0.9 |
| Example 7 | 17.2 | 0.51 | 3.96 | <0.01 | <0.01 | <0.01 | <0.01 | 3.8504 | ○ | 40 | 16.3 | 22 | 13.5 | 225 | 0.8 |
| Comparative Example 1 | 17.7 | 0.52 | 0.02 | <0.01 | <0.01 | <0.01 | <0.01 | −0.0986 | x | 110 | 15.4 | 46 | 12.2 | 194 | 0.5 |
| Comparative Example 2 | 17.5 | 0.48 | 5.88 | <0.01 | <0.01 | <0.01 | <0.01 | 5.765 | ○ | 87 | 13.4 | 55 | 15.5 | 177 | 0.1 |

As described above, in the Al—Si—Fe-based aluminum alloy according to the present embodiment, a cooling rate of the molten alloy having the above-described alloy composition is 500° C./s or more, so that the fine Al—Cr—Si-based compound that has high coherency with the crystal structure of the Si-based compound crystallizes out, and the fine Al—Cr—Si-based compound acts as the crystallization nucleus of the Si-based compound.

In order to achieve the cooling rate of the molten alloy at 500° C./s or more, the temperature of the mold may be adjusted. For example, the Al—Si—Fe-based aluminum alloy casting material according to the present embodiment may be cast by die-casting or the like.

In the Al—Si—Fe-based aluminum alloy according to the present embodiment, when the cooling rate of the molten alloy is 500° C./s or more, it is more likely to generate a supercooled state at 30° C. or more than the liquidus line temperature of the molten alloy having the above-described alloy composition. Through this supercooled state, the Si-based compound and the Al—Fe—Si-based compound almost simultaneously crystallize out. A difference in crystallization temperature between the Si-based compound and the Al—Fe—Si-based compound is considered to be about 55° C. Accordingly, the molten alloy having the alloy composition is solidified by generating the supercooled state at 30° C. or more than the liquidus line temperature, so that the difference in crystallization temperature between the Si compound and Al—Fe—Si-based compound is made small. Consequently, the Si-based compound and the Al—Fe—Si-based compound are more likely to simultaneously crystallize out. For example, the liquidus line temperature is 642°

In Examples 1 to 7 and Comparative Examples 1 and 2, tensile strength and elongation of each Al—Si—Fe-based aluminum alloy casting material of Examples 1 to 7 and Comparative Examples 1 and 2 were measured in accordance with the test procedure based on JIS 22241. The measurement results are listed in Table 2.

In Examples 1 to 7 and Comparative Examples 1 and 2, the alloy structures were observed using an optical microscope and the images of the structures were photographed. The circle equivalent diameter of the Si-based crystallized product and that of the Al—Fe—Si-based compound were measured based on the photographed image using image analysis software KS400 manufactured by Karl Zeiss AG. Each of the maximum diameters of the measured grain diameters is listed as Size in Table 2.

In Examples 1 to 7 and Comparative Examples 1 and 2, the alloy structures were observed using the optical microscope and the images of the structures were photographed. The area ratio per unit area of the Si-based crystallized products and that of the Al—Fe—Si-based compounds were determined using the image analysis software and are listed in Table 2.

As listed in Table 2, the Cr content in the alloy composition of Comparative Example 1 is less than 0.17% by mass as compared with those in the alloy compositions of Examples 1 to 7. Accordingly, it can be found that a particle size of the Si-based crystallized product in Comparative Example 1 is more than 100 μm, and thus the coarsening of the particle diameter occurs. It can be found that a particle size of the Al—Fe—Si-based compound in Comparative Example 1 is more than 30 μm and thus the coarsening of the particle diameter occurs. Further, it can be found that the tensile strength and the elongation of the cast in Comparative Example 1 are smaller than the tensile strength and the elongation of each of the casts in Examples 1 to 7.

As listed in Table 2, the Cr content in the alloy composition of Comparative Example 2 is more than 5.00% by mass as compared with those in the alloy compositions of Examples 1 to 7. Therefore, it can be found that the Al—Fe—Si-based compound in Comparative Example 2 has a particle diameter of more than 30 μm, and thus the coarsening of the particle diameter occurs. Further, it can be found that the tensile strength and the elongation of the cast in Comparative Example 2 are smaller than the tensile strength and the elongation of each of the casts in Examples 1 to 7.

Figure 2:
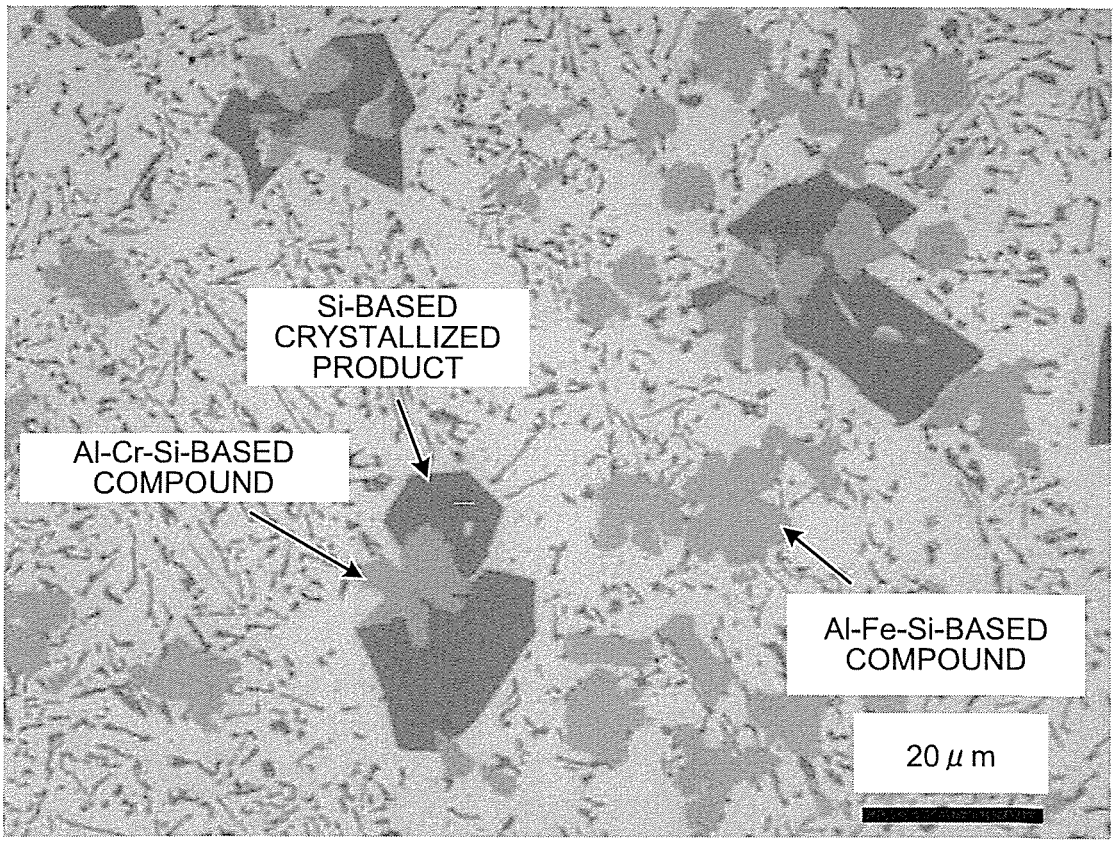
FIG. 2 is a diagram for explaining a photograph of an alloy structure in Example 7 of the Al—Si—Fe-based aluminum alloy casting material according to an embodiment.

FIG. 2 is the photograph of the alloy structure in Example 7 of the Al—Si—Fe-based aluminum alloy casting material according to the present embodiment. In the alloy structure illustrated in FIG. 2, the granular Al—Fe—Si-based compound is observed. A large amount of Si-based compound exists around the Al—Cr—Si-based compound. In the alloy structure illustrated in FIG. 2, the state in which the Al—Cr—Si-based compound is surrounded by the Si-based crystallized product can be observed. Further, in FIG. 2, the state of Al—Cr—Si-based compound can be observed, in which the Al—Cr—Si-based compound is not completely surrounded by the Si-based crystallized product but is in contact with the Si-based crystallized product. Through the study of the composition of the Al—Cr—Si-based compound using n=8, the composition was assumed to be in the range of $Al_{13-15}Cr_4Si_{4-5}$ and thus was assumed as α-AlCrSi ($Al_{13}Cr_4Si_4$) which was determined from an Al—Cr—Si ternary phase diagram.

Various useful examples of the present embodiment have been illustrated and described above. The present embodiment is not limited to Examples described above or modifications thereof, and it goes without saying that various changes can be made in the embodiment without departing from the gist of the present embodiment or the attached claims.

The invention claimed is:

1. An Al—Si—Fe-based aluminum alloy casting material having a composition, the composition comprising:

Si, a content of which is 12.0% by mass or more and 25.0% by mass or less;

Fe, a content of which is 0.48% by mass or more and 4.0% by mass or less;

Cr, a content of which is 0.17% by mass or more and 5.0% by mass or less; and a remainder composed of Al and unavoidable impurities, wherein the casting material includes a structure, in which a Si-based crystallized product surrounds an Al—Cr—Si-based compound that is α-AlCrSi.

2. The Al—Si—Fe-based aluminum alloy casting material according to claim 1, wherein the content of Cr and the content of Si satisfy the following formula (1):

$$Cr>0.018\times Si-0.2 \quad (1).$$

3. The Al—Si—Fe-based aluminum alloy casting material according to claim 1, wherein the structure further includes an Al—Fe—Si-based crystallized product, an area ratio of the Al—Fe—Si-based crystallized product is 5% or more;

a maximum diameter of the Al—Fe—Si-based crystallized product is 30 μm or less;

an area ratio of the Si crystallized product is 12% or more; and a maximum diameter of the Si-based crystallized product is 100 μm or less.

4. The Al—Si—Fe-based aluminum alloy casting material according to claim 1, further comprising any one or more elements of:

Cu, a content of which is 0.5% by mass or more and 8.0% by mass or less;

Ni, a content of which is 0.5% by mass or more and 6.0% by mass or less;

Mg, a content of which is 0.05% by mass or more and 1.5% by mass or less;

P, a content of which is 0.003% by mass or more and 0.02% by mass or less;

Mn, a content of which is 0.3% by mass or more and 1.0% by mass or less;

Ti, a content of which is 0.005% by mass or more and 1.0% by mass or less;

B, a content of which is 0.001% by mass or more and 0.01% by mass or less;

Zr, a content of which is 0.01% by mass or more and 1.0% by mass or less; and

V, a content of which is 0.01% by mass or more and 1.0% by mass or less.

* * * * *